US008918936B2

(12) United States Patent
Altinier et al.

(10) Patent No.: US 8,918,936 B2
(45) Date of Patent: Dec. 30, 2014

(54) LAUNDRY WASHING MACHINE WITH AN ELECTRONIC DEVICE FOR SENSING THE MOTION OF THE WASH ASSEMBLY DUE TO THE DYNAMIC UNBALANCE OF THE WASH LAUNDRY DRUM ASSEMBLY, AND RELATIVE OPERATING METHOD

(75) Inventors: Fabio Altinier, Codogne (IT); Terenzio Girotto, Sesto Al Reghena (IT); Marco Giovagnoni, Udine (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1291 days.

(21) Appl. No.: 12/739,367

(22) PCT Filed: Oct. 10, 2008

(86) PCT No.: PCT/EP2008/008551

§ 371 (c)(1),
(2), (4) Date: Aug. 23, 2010

(87) PCT Pub. No.: WO2009/049825

PCT Pub. Date: Apr. 23, 2009

(65) Prior Publication Data

US 2010/0306926 A1 Dec. 9, 2010

(30) Foreign Application Priority Data

Oct. 18, 2007 (EP) ..... 07118827

(51) Int. Cl.
*D06F 37/20* (2006.01)
*D06F 37/22* (2006.01)

(52) U.S. Cl.
CPC ..... *D06F 37/203* (2013.01)
USPC ..... 8/158; 8/159; 68/12.01; 68/12.02; 68/12.04; 68/12.06

(58) Field of Classification Search
None
See application file for complete search history.

(56) References Cited

U.S. PATENT DOCUMENTS 6,032,494 A * 3/2000 Tanigawa et al. ..... 68/12.06
2006/0242768 A1 11/2006 Zhano et al.

FOREIGN PATENT DOCUMENTS

| | | | |
|---|---|---|---|
| DE | 19928657 | A1 | 12/2000 |
| EP | 1113102 | A | 7/2001 |
| GB | 2270090 | A | 3/1994 |
| GB | 2271837 | A | 4/1994 |

OTHER PUBLICATIONS

International Search Report for PCT/EP2008/008551 (WO2009/049825), mailed Mar. 11, 2009.

* cited by examiner

*Primary Examiner* — Joseph L Perrin
*Assistant Examiner* — Levon J Shahinian
(74) *Attorney, Agent, or Firm* — Banner & Witcoff, Ltd.

(57) ABSTRACT

A method of sensing the motion of the wash assembly (3) of a washing machine (1) due to the dynamic unbalance of the laundry drum assembly (6), and which comprises the steps of: increasing the rotation speed ($\omega$) of a laundry drum (6) to a first rotation speed ($\omega_{DIST}$); determining a first parameter ($T_{FRICTION}$; $A_{HFREF}$) related to the time pattern of the values of an unbalance function $A=T-Jd\omega/dt$; increasing the rotation speed ($\omega$) of the laundry drum (6) by a predetermined value ($\Delta\omega$) determining, at each increase ($\Delta\omega$) in rotation speed ($\omega$), a second parameter ($A_{LF}$; $A_{HF}$) related to the time pattern of the values of the unbalance function $A=T-Jd\omega/dt$ filtered at the predetermined filtration frequency (LF; HF); calculating the difference ($T_{dynLF}$; $T_{dynHF}$) between the second parameter ($A_{LF}$; $A_{HF}$) and the first parameter ($T_{FRICTION}$; $A_{HFREF}$).

22 Claims, 5 Drawing Sheets

LAUNDRY WASHING MACHINE WITH AN ELECTRONIC DEVICE FOR SENSING THE MOTION OF THE WASH ASSEMBLY DUE TO THE DYNAMIC UNBALANCE OF THE WASH LAUNDRY DRUM ASSEMBLY, AND RELATIVE OPERATING METHOD

BACKGROUND OF THE INVENTION

The present invention relates to a laundry washing machine with an electronic device for sensing the motion of the wash assembly due to the dynamic unbalance of the wash laundry drum assembly, and to the relative operating method.

More specifically, the present invention relates to a home laundry washing machine or combination washing machine-drier equipped with a device for evaluating a dynamic unbalance parameter related to the torque and speed acting on the wash assembly of the machine as a result of dynamic unbalance effects, and for accordingly activating or not the spin stage; to which the following description refers purely by way of example.

Home washing machines are known to comprise a casing, a laundry wash assembly comprising a cylindrical tub connected in floating manner to casing by suspension devices, a laundry drum mounted inside the tub to rotate freely about a longitudinal axis of rotation; and an electric motor connected mechanically to laundry drum by a transmission system to rotate laundry drum about longitudinal axis of rotation inside tub.

It is important to point out that the term "laundry drum assembly" will be intended to mean the assembly comprising the laundry drum, the laundry arranged into the laundry drum, and all the rotating parts of a transmission system used to impress the rotating motion to the laundry drum, i.e. pulleys, transmission shafts, and rotor of the electric motor.

In addition home washing machines comprises electronic control devices for measuring a physical parameter related to unbalance of the laundry drum assembly caused by random distribution of the laundry inside the laundry drum of the wash assembly, and accordingly determining potentially critical overall unbalance of the laundry drum assembly.

The main purpose of such devices is to achieve a predetermined spin speed of the laundry drum inside the wash assembly without producing unbalance of the laundry drum assembly over and above a maximum permissible threshold, which poses various problems in the machine, such as: collision of the wash assembly with the machine casing, and/or severe vibration resulting in a high noise level, and/or partial deformation of the laundry drum, and/or mechanical stress of the drum supporting members, i.e. bearings, dampers, springs, inside the wash assembly.

Unbalance of the laundry drum assembly of a washing machine caused by random distribution of the laundry inside the laundry drum can be divided substantially into two unbalance components, each associated with a respective distribution pattern of the laundry inside the laundry drum, and with a given rotation of the laundry drum caused by the distribution pattern.

More specifically, a first theoretical unbalance component—known as static unbalance and shown in the FIG. 1 example—is represented by a first static mass $M_S$ distribution pattern, in which the static mass $M_S$ is concentrated at one point on the inner wall of a laundry drum T.

More specifically, in the first distribution pattern, mass $M_S$ is located inside laundry drum T with its barycentre $B_{MS}$ aligned vertically with the barycentre $B_{TS}$ of wash assembly; and, as laundry drum T rotates, the first theoretical distribution pattern of static mass $M_S$ produces a substantially cylindrical rotation C (shown by the dash line) of the longitudinal axis L of laundry drum T with respect to its rest position. In other words, the cylindrical component of rotation of longitudinal axis L of laundry drum T is mainly associated with the "static unbalance" component of the laundry.

The second unbalance component—known as "dynamic unbalance" (shown schematically in FIG. 2)—is associated with a second laundry distribution pattern represented by two masses $M_{AD}$ and $M_{PD}$, which are equal in weight, and are located opposite each other with respect to a vertical axis through the barycentre $B_{TD}$ of wash assembly; and, as laundry drum T rotates, the distribution pattern of the two masses $M_{AD}$ and $M_{PD}$ produces a substantially conical rotation of longitudinal axis L with respect to its rest position. In this case, projection of the rotation of longitudinal axis L in a plane perpendicular to longitudinal axis L in non-rotation conditions is defined by an ellipse E (shown by a dash line in FIG. 2).

In other words, the conical component of rotation of longitudinal axis L of laundry drum T with respect to its rest position is mainly associated with the "dynamic unbalance" component of the laundry.

Though efficient, known control devices have the major drawback of determining unbalance of the laundry drum assembly solely on the basis of "static unbalance" as described above, i.e. associated solely with the "cylindrical component" of rotation of the longitudinal axis of the laundry drum assembly (FIG. 1), and of failing to determine the "dynamic unbalance", i.e. "conical" unbalance component (FIG. 2).

Known control devices, in fact, determine unbalance of the laundry drum assembly by processing the fluctuation in speed or torque acting in the wash assembly and imparted by its electric drive motor for regulating the rotating speed. Fluctuation in speed or torque, however, is related mainly to static unbalance, and provides no useful information concerning dynamic unbalance, which, being produced by a distribution pattern defined by two opposite masses of equal weight, produces weak fluctuation in the speed or torque imparted to the laundry drum assembly by the electric motor and therefore it cannot be determined using known control devices of the type described above.

SUMMARY OF SELECTED INVENTIVE ASPECTS

It is an object of the present invention, therefore, to provide a laundry washing machine equipped with a device for sensing the motion of the wash assembly due to the "dynamic" unbalance of a wash laundry drum assembly, so as to prevent spin speed from being attained when "dynamic" unbalance exceeds a given threshold jeopardizing the washing machine.

According to the present invention, there is provided a method of operating a washing machine, as claimed in Claim 1 and preferably, though not necessarily, in any one of the Claims depending directly or indirectly on Claim 1.

According to the present invention, there is also provided a washing machine as claimed in Claim 8 and preferably, though not necessarily, in any one of the Claims depending directly or indirectly on Claim 8.

According to the present invention, there is also provided an electronic control device for sensing the motion of the wash assembly due to the dynamic unbalance of a laundry drum assembly of a washing machine, as claimed in Claim 9.

According to the present invention, there is also provided a software product loadable into a memory of processing means, as claimed in Claim 10.

BRIEF DESCRIPTION OF THE DRAWINGS

A non-limiting embodiment of the present invention will be described by way of example with reference to the accompanying drawings, in which.

DETAILED DESCRIPTION OF ILLUSTRATIVE EMBODIMENTS

Figure 3:
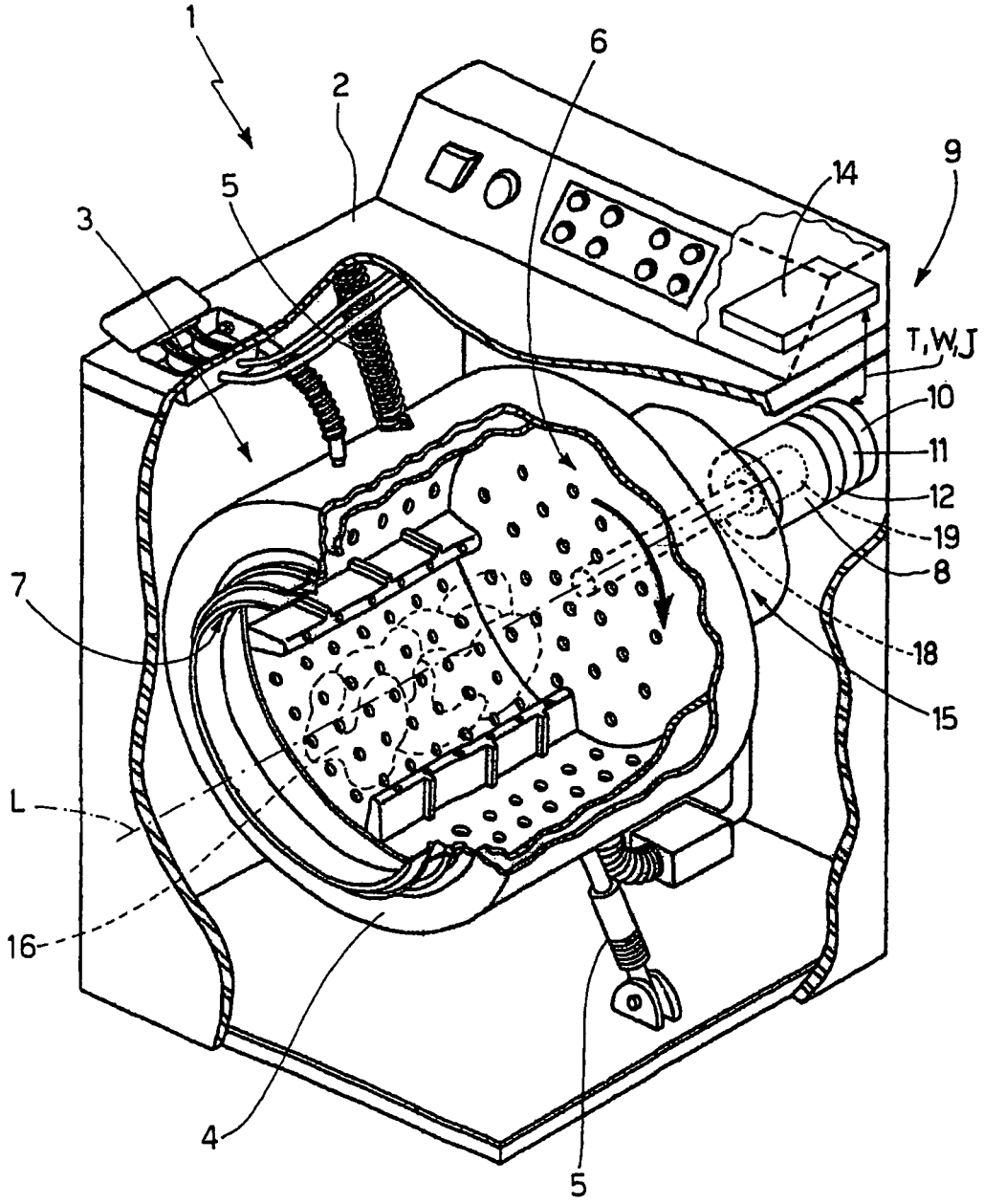
FIG. 3 shows a schematic, with parts in section and parts removed for clarity, of a washing machine in accordance with the teachings of the present invention.

With reference to FIG. 3, number 1 indicates as a whole a washing machine comprising a preferably, though not necessarily, parallelepiped-shaped casing 2; and a laundry wash assembly 3, in turn comprising a preferably, though not necessarily, cylindrical tub 4 connected in floating manner to casing 2 by suspension devices 5, and a laundry drum 6 mounted inside tub 4 to rotate freely about a longitudinal axis of rotation L.

Laundry drum 6 has a front opening 7 closed selectively by a door (not shown) hinged to casing 2; and wash assembly 3 comprises an electric motor 8 connected mechanically to laundry drum 6 by a transmission system to rotate laundry drum 6, on command, about longitudinal axis of rotation L inside tub 4.

It is important to point out that term "laundry drum assembly" 15 will be intended to mean the assembly comprising the laundry drum 6, the laundry 16 located inside the laundry drum 6, and all the rotating parts of a transmission system used to impress the rotating motion to the laundry drum 6, comprising transmission shafts 18, and rotor 19 of the electric motor 8 (FIG. 3).

Washing machine 1 also comprises a control device 9 for sensing the motion of the wash assembly 3 due to the dynamic unbalance of laundry drum assembly 15, and which comprises a regulating block 10 for regulating the rotation speed ω imparted to laundry drum 6 by the electric motor 8; a measuring block 11 for measuring the torque T imparted to laundry drum assembly 15 by an electric motor 8; and a measuring block 12 for measuring the total moment of inertia J of the laundry drum assembly 15.

Rotation speed regulating block 10, torque T measuring block 11, and inertia J measuring block 12 are known and therefore not described in detail, except to state that measuring block 12 measures inertia J as a function of torque T, and of the rotation speed ω imparted to the laundry drum 6 by the electric motor 8.

Control device 9 also comprises a processing and control block 14, which provides for implementing the method of sensing the motion of the wash assembly 3 due to the dynamic unbalance of laundry drum assembly 15 as described in detail below.

First, however, it should be pointed out that the dynamic unbalance of laundry drum assembly 15 (shown in FIG. 2) produces an increment in torque that can be described mathematically by the following mathematical formulas, assuming motion is conical with an elliptical cross section:

$$\theta_y = \theta_{y0}\cos(\omega t + \pi/2 + \phi) \qquad 1)$$
$$\theta_z = \theta_{z0}\cos(\omega t + \phi)$$

$$T_y = \omega^2 \cdot d \cdot \cos(\omega t + \delta) \qquad 2)$$
$$T_z = \omega^2 \cdot d \cdot \cos(\omega t - \pi/2 + \delta)$$

$$T_{dyn} = \frac{(\theta_{y0} + \theta_{z0})}{2} \cdot \omega^2 \cdot d \cdot \cos(\phi - \delta) + \frac{(\theta_{z0} - \theta_{y0})}{2} \cdot \omega^2 \cdot d \cdot \cos(2\omega t + \phi + \delta) \qquad 3)$$

$$T_{dyn} = Td_{ynLF} + T_{dynHF} \qquad 4)$$

where d is the total dynamic unbalance of the laundry load (d=mRb, m is the dynamic mass $M_{AD}$ or $M_{PD}$, R is the laundry drum radius, and b is the arm between the two dynamic masses $M_{AD}$ and $M_{PD}$).

Figure 1:
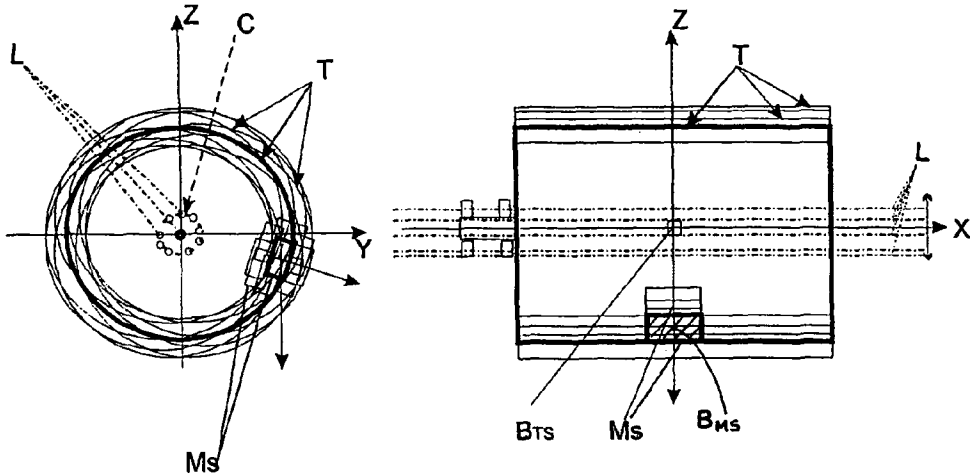
FIG. 1 shows, schematically, a static unbalance inside a laundry drum assembly of a washing machine, and the cylindrical motion of the longitudinal axis of laundry drum produced as the laundry drum rotates.
Figure 2:
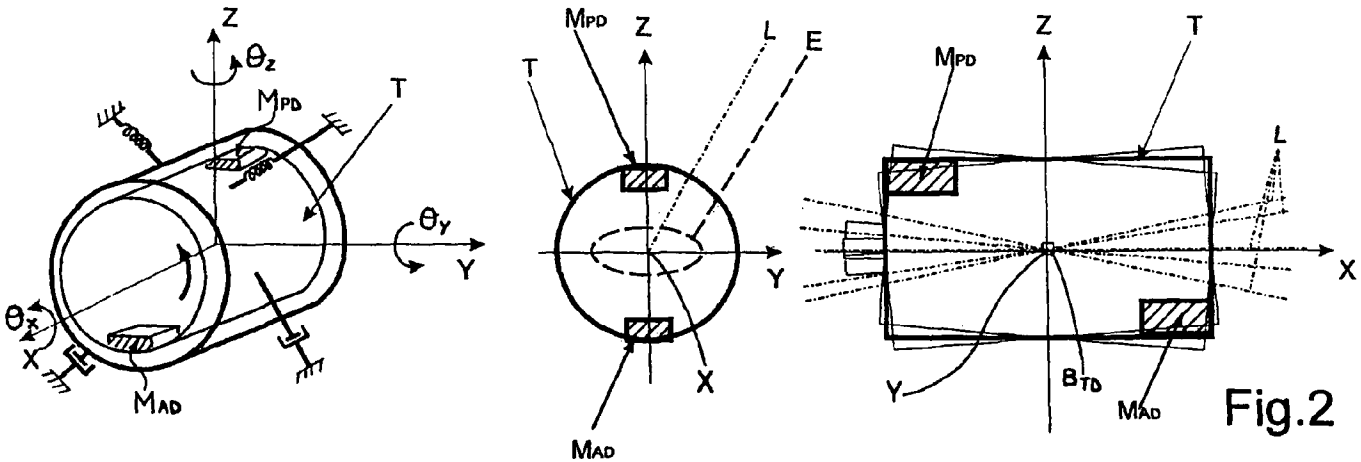
FIG. 2 shows, schematically, a dynamic unbalance inside the laundry drum assembly of a washing machine, and the conical motion of the longitudinal axis of laundry drum produced as the laundry drum rotates.

The first set of formulas 1) defines the rotations θy and θz of the wash assembly, measured in the principal axes of the elliptical cross section of the cone of motion (FIG. 2).

The second set of formulas 2) defines the components Ty and Tz of the centrifugal torque produced by the dynamic unbalance, measured in the same principal axes of the ellipse.

The phase angle ϕ represents the phase shift of rotations with respect to the centrifugal torque: the phase angle ϕ defines the phase relation of the output (wash assembly rotations) with respect to the input (the rotating torque due to the dynamic unbalance of the load).

Angle δ defines the angular position of the vector of the centrifugal torque with respect to the frame of reference rotating with the drum.

The third formula 3) defines the additional torque acting on the laundry drum 6 due to the dynamic unbalance. In the present description, the additional torque is called "dynamic torque" $T_{dyn}$. The third formula 3) consists of two terms as indicated in formula 4): a quasi-static term $T_{dynLF}$ and a second-harmonics term $T_{dynHF}$, both of which depend on the value of dynamic unbalance and on the square of rotation speed.

The quasi-static term $T_{dynLF}$ depends on $\frac{1}{2}\cdot(\theta_{y0}+\theta_{z0})$ which is the average value of the principal flare angles of the cone of motion. The quasi-static term $T_{dynLF}$ is therefore related to the conical motion of wash assembly 3.

The absolute value of the quasi-static part of the dynamic torque $T_{dynLF}$ grows up to a maximum value when passing through the wash assembly resonances showing conical motions of the laundry drum assembly. This maximum value is related to both the dynamic unbalance and the motion amplitude: larger maximum values correspond to larger dynamic unbalances and larger cones of motion (and vice-versa). When passing through resonances, the quasi-static part of the torque output by the electric motor will necessarily grow up to counterbalance the quasi-static term of the dynamic torque, which is a negative braking torque: physically this means that a larger power will be dissipated in the shock absorbers due to the larger amplitude in the conical motion of the wash assembly 3.

The second-harmonics term of formula 3) depends on $\frac{1}{2}\cdot(\theta_{z0}-\theta_{y0})$ which is related to the shape of the conical motion: if this value is zero, the cross section of the cone is a circle.

The formula 3) highlights that it is not possible to have a measure of the dynamic unbalance in $Kg*m^2$ units, because both the terms $T_{dynLF}$ and $T_{dynHF}$ depend on the product of dynamic unbalance by a function of rotation amplitude ($\frac{1}{2}\cdot(\theta_{y0}+\theta_{z0})$ and $\frac{1}{2}\cdot(\theta_{z0}-\theta_{y0})$) and not only on one of them. However, by speeding up the washer, only if the absolute value of term $T_{dynLF}$ (or term $T_{dynHF}$) is lower than a given threshold, an excessive dynamic unbalance in the spin phase can be avoided.

The present invention is based on the fact that it is possible to detect the effects of dynamic unbalance in terms of motion of the wash assembly 3 by reading the speed and torque signals output by the motor. If the motion of the wash assembly is sensed from the motor speed and torque signals, the dynamic unbalance can be taken under control. As a matter of fact, if the wash assembly is clamped as for shipping, this procedure cannot work because all the wash assembly movements are inhibited.

Research shows that a gradual increase in rotation speed $\omega$ of laundry drum 6 within a resonance speed range $D_{FR}$ of wash assembly 3 produces an increase in the amplitude of a component $A_{LF}$, at a low frequency LF, of an unbalance function $A=T-\omega/dt$.

More specifically, research shows the amplitude of the low-frequency component $A_{LF}$, cleansed of a value associated with the friction torque $T_{FRICTION}$ to which laundry drum assembly 15 is subjected as the laundry drum 6 rotates, to be related to the quasi-static component $T_{dynLF}$ of dynamic unbalance torque $T_{dyn}$ described above.

In the case in point, the increase in the amplitude of the component $A_{LF}$ at low frequency LF of unbalance function $A=T-Jd\omega/dt$ within resonance frequency range $D_{FR}$, cleansed of the friction torque $T_{FRICTION}$ of the laundry drum assembly 15, is related to the quasi-static component $T_{dynLF}$ of torque $T_{dyn}$ to which laundry drum assembly 15 is subjected as a result of dynamic unbalance effects.

It should be pointed out that "low frequency" is intended to mean a frequency quite lower to the rotation frequency of laundry drum assembly 15. For example, a 120 rpm rotation speed of laundry drum assembly 15 corresponds to 2 Hz frequency and the low frequency LF is between 0 Hz and a few tenths of Hz.

Figure 4:
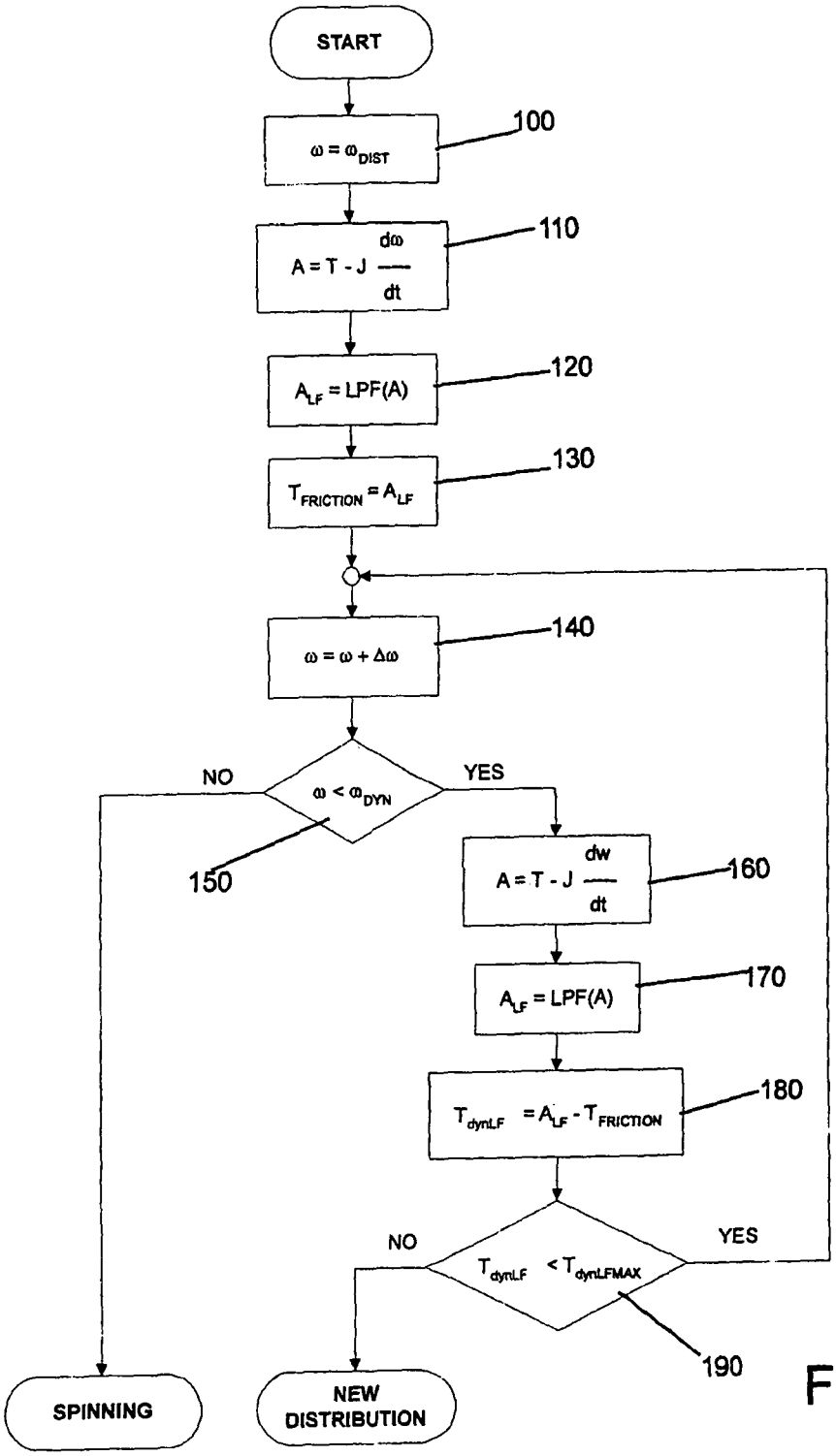
FIG. 4 shows an operation flow chart of the method of operating the FIG. 3 washing machine.

With reference to the FIG. 4 flow chart, the method implemented by processing block 14 provides first of all for increasing the rotation speed $\omega$ of laundry drum 6 gradually to a rotation speed $\omega_{DIST}$ corresponding to the minimum rotation speed of laundry drum 6 at which the laundry adheres completely to the inner wall of laundry drum 6 in a fixed random distribution pattern. It should be pointed out that rotation speed $\omega_{DIST}$ represents the minimum rotation speed at which the laundry begins maintaining a fixed distribution pattern inside laundry drum 6 (block 100). In the case in point, rotation speed $\omega_{DIST}$ may be about 110 rpm.

Once the fixed laundry distribution pattern inside laundry drum 6 is achieved, rotation speed $\omega=\omega_{DIST}$ is maintained constant for a given time interval dt1, during which the method processes unbalance function $A=T-Jd\omega/dt$ (block 110).

At this stage, the method filters the component of unbalance function $A=T-Jd\omega/dt$ having a low frequency LF, to determine the amplitude of low-frequency component $A_{LF}$ (block 120).

Figure 5:
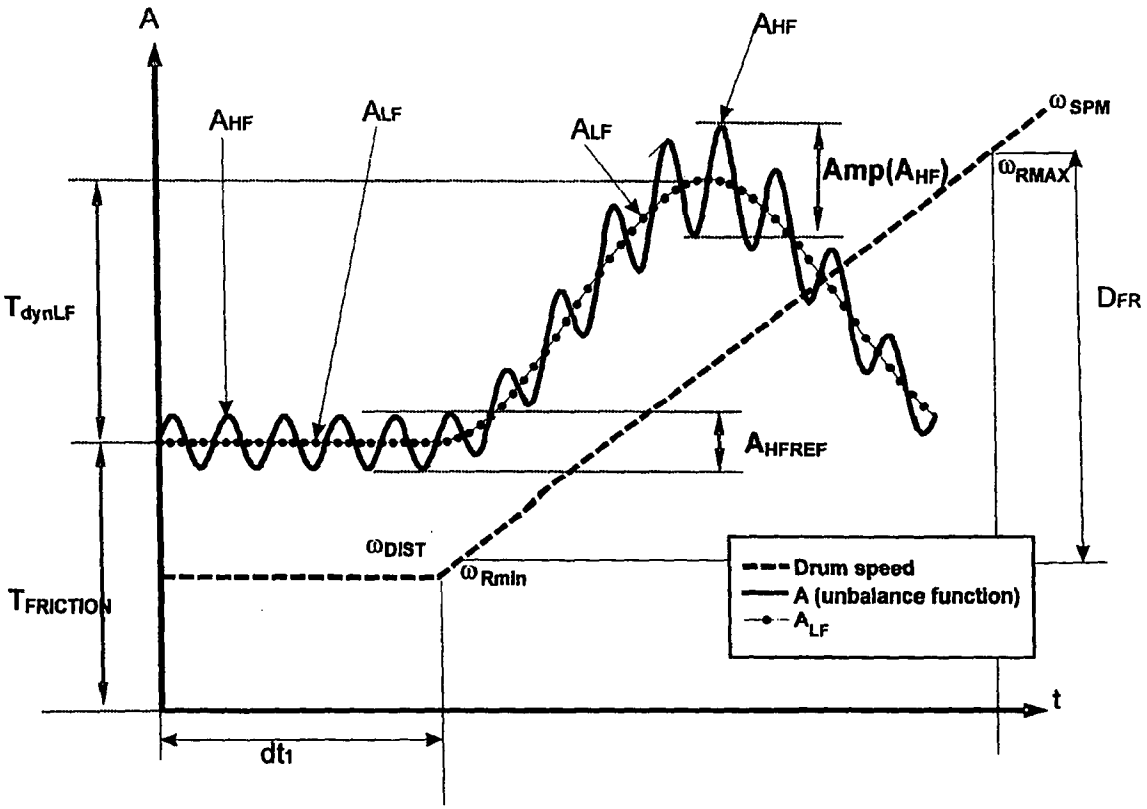
FIG. 5 shows a time graph of the low-frequency- and high-frequency-filtered unbalance function A.

It should be pointed out that, once rotation speed $\omega_{DIST}$ is reached, angular acceleration of laundry drum 6 is practically zero, so the torque T imparted to laundry drum assembly 15 by electric motor 8 practically equals the torque T required to overcome the friction to which laundry drum assembly 15 is subjected as laundry drum 6 rotates, and the following equation applies: $T_{FRICTION}=A_{LF}$. Friction torque $T_{FRICTION}$, in fact, equals the amplitude of the component $A_{LF}$ at low frequency LF of unbalance function A (block 130) (FIG. 5).

At this point, regulating block 10 repeatedly increases rotation speed $\omega$ by a predetermined value $\Delta\omega$ (block 140) to gradually cover a predetermined rotation speed range $D_{FR}$ of laundry drum 6, within which resonance of wash assembly 3 occurs. The resonance rotation speed range $D_{RR}$ may range between a minimum rotation speed $\omega_{Rmin}$ of about 120 rpm and a maximum rotation speed $\omega_{RMAX}$ of about 250 rpm.

At each increase $\Delta\omega$, the method determines (block 150) whether current rotation speed $\omega$ is below a predetermined maximum rotation speed $\omega_{DYN}$, which is a predetermined value higher or equal to $\omega_{RMAX}$.

If current rotation speed $\omega$ is below predetermined maximum rotation speed $\omega_{DYN}$ (YES output of block 150), the method performs the following steps in sequence: calculates unbalance function $A=T-Jd\omega/dt$ at predetermined time intervals (block 160); filters component $A_{LF}$ at low frequency LF of unbalance function $A=T-Jd\omega/dt$ (block 170); and determines a dynamic unbalance parameter corresponding to quasi-static component $T_{dynLF}$ of dynamic unbalance torque $T_{dyn}$ (block 180) according to the equation:

$$T_{dynLF}=A_{LF}-T_{FRICTION}$$

At this point, processing block 14 determines (block 190) whether the amplitude of the dynamic unbalance parameter, i.e. quasi-static component $T_{dynLF}$, is below a predetermined threshold $T_{dynLFMAX}$, which, in the case in point, is associated with an unacceptably hazardous dynamic unbalance condition of the laundry drum assembly 15, and in consequence an unacceptably motion of the wash assembly 3.

If the dynamic unbalance parameter, i.e. quasi-static component $T_{dynLF}$, is below the predetermined threshold $T_{dynLFMAX}$, (YES output of block 190), processing block 14 determines an acceptable dynamic unbalance condition and an acceptable motion of the wash assembly 3, again increases rotation speed $\omega$ by predetermined value $\Delta\omega$ (block 140), and repeats the controls performed in blocks 150, 160, 170, 180 and 190 as described above.

Conversely, if the dynamic unbalance parameter, i.e. quasi-static component $T_{dynLF}$, exceeds the predetermined threshold $T_{dynLFMAX}$, (NO output of block 190), processing block 14 determines an unacceptably hazardous dynamic unbalance condition and in consequence an unacceptably motion of the wash assembly 3, commands regulating block 10 to immediately reduce rotation speed $\omega$ to achieve a random redistribution of the laundry inside laundry drum 6, and, once the laundry is redistributed, again performs the control method described above.

Dynamic unbalance control terminates when rotation speed $\omega$ of laundry drum 6 reaches a predetermined maximum rotation speed $\omega_{DYN}$ (NO output of block 150) corresponding, for example, to $\omega_{RMAX}$.

In the event no unacceptable dynamic unbalance condition is detected over the whole resonance range $D_{FR}$, the method authorizes the spin stage, and increases rotation speed $\omega$ to the wash cycle spin speed $\omega_{SPIN}$.

Washing machine 1 described above has the major advantage of specifically detecting the presence of the dynamic component of the unbalance of the laundry drum assembly as the laundry drum rotates, and so greatly reducing the risk of the wash assembly colliding with the machine casing at the spin stage.

Clearly, changes may be made to the washing machine and operating method as described and illustrated herein without, however, departing from the scope of the present invention, as defined in the accompanying Claims.

Figure 6:
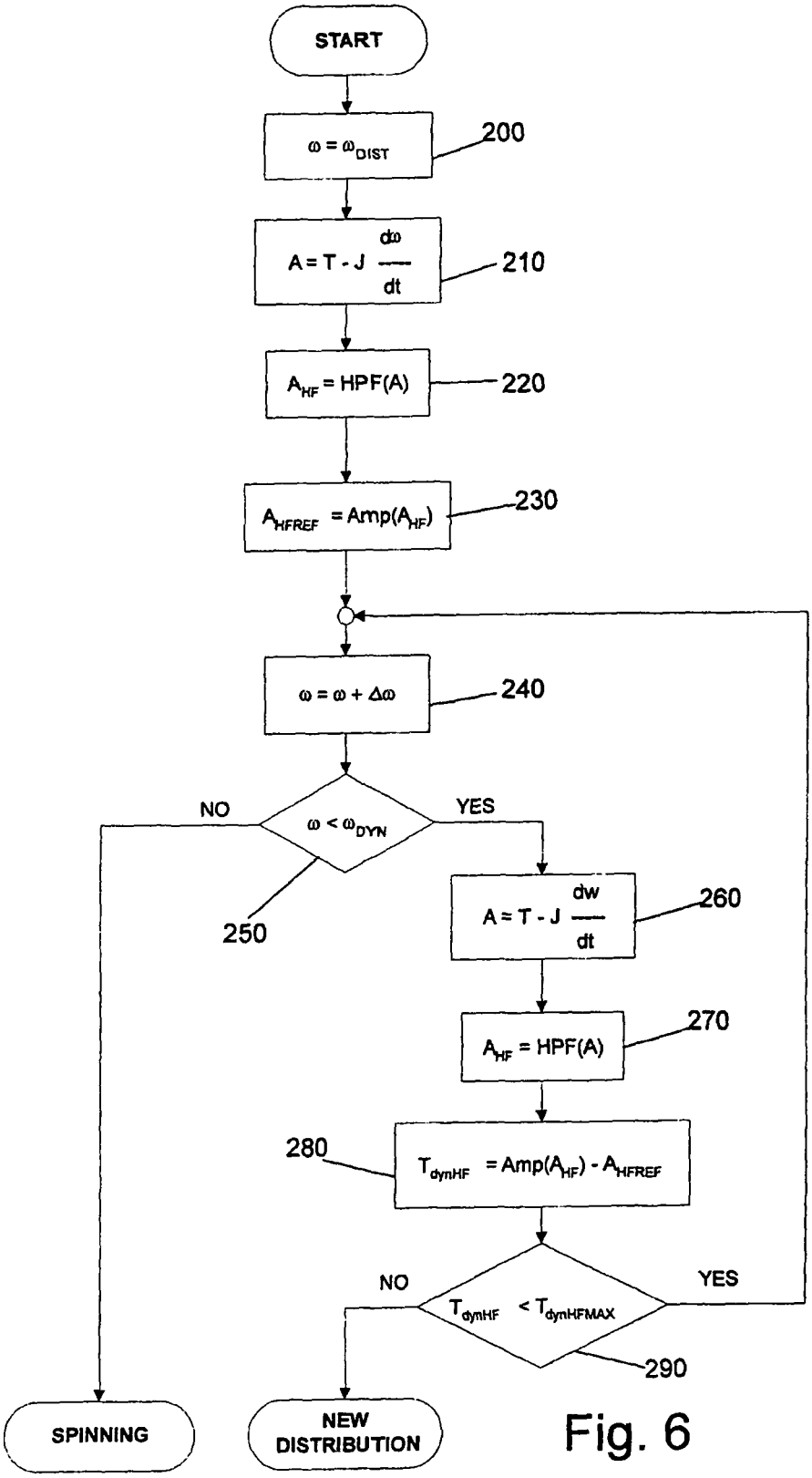
FIG. 6 shows an operation flow chart of a variation of the method of operating the FIG. 3 washing machine.

More specifically, in the FIG. 6 variation, the method implemented by processing block 14 detects the presence of the dynamic unbalance component as a function of component $T_{dynHF}$ corresponding to the second harmonic of dynamic unbalance torque $T_{dyn}$, as opposed to quasi-static component $T_{dynLF}$ as described above.

More specifically, research shows that, in resonance conditions of wash assembly 3, the amplitude of the component $A_{HF}$ at high frequency HF of the unbalance function A undergoes an increase $\Delta A_{HF}$ with respect to a reference value $A_{HFREF}$ of the amplitude of component $A_{HF}$ measured in non-resonance conditions of the wash assembly 3 and at constant rotation speed. More specifically, increase $\Delta A_{HF}$ in amplitude is related to the second harmonic $T_{dynHF}$ of dynamic unbalance torque $T_{dyn}$ described above.

In the case in point, the increase in the amplitude of component $A_{HF}$ at high frequency HF of unbalance function $A=T-Jd\omega/dt$ in the resonance frequency range $D_{FR}$, cleansed of its initial reference value $A_{HFREF}$, is related to the second harmonic $T_{dynHF}$ of the torque $T_{dyn}$ to which laundry drum assembly 15 is subjected as a result of dynamic unbalance effects.

It should be pointed out that "high frequency" is intended to mean a frequency equal to twice the rotation frequency of laundry drum assembly 15. For example, a 240 rpm rotation speed corresponds to a rotation frequency of 4 Hz, so the high frequency to calculate second harmonic $T_{dynHF}$ is roughly 8 Hz.

With reference to the FIG. 6 flow chart, the method implemented by processing block 14 provides first of all for increasing the rotation speed ω of laundry drum assembly 15 gradually to a rotation speed $\omega_{DIST}$ corresponding to the minimum rotation speed of laundry drum assembly 15 producing a fixed distribution of the laundry inside laundry drum 6 (block 200).

Once the fixed laundry distribution on the inner wall of laundry drum 6 is achieved, rotation speed ω is maintained constant for a given time interval dt1, during which the method processes unbalance function $A=T-Jd\omega/dt$ (block 210) (FIG. 5).

At this stage, the method filters the component $A_{HF}$ of unbalance function $A=T-Jd\omega/dt$ having a frequency equal to the predetermined high frequency HF (block 220).

At this point, the method assigns the filtered component $A_{HF}$ to reference value $A_{HFREF}$ (block 230). With reference to FIG. 5, it should be pointed out that value $A_{HFREF}$ corresponds to the maximum amplitude, i.e. peak-to-peak oscillation, of the component $A_{HF}$ of unbalance function A having a frequency equal to the predetermined high frequency HF.

At this point, regulating block 10 repeatedly increases rotation speed ω by a predetermined value Δω (block 240) within the predetermined rotation speed range $D_{FR}$ of laundry drum 6 in which resonance of wash assembly 3 occurs.

At each increase Δω, the method determines (block 250) whether current rotation speed ω is below the predetermined maximum rotation speed $\omega_{DYN}$.

If current rotation speed ω is below predetermined maximum rotation speed $\omega_{mm}$ (YES output of block 250), the method performs the following steps in sequence: calculates unbalance function $A=T-Jd\omega/dt$ at predetermined time intervals (block 260); and filters' the component $A_{HF}$ of unbalance function $A=T-Jd\omega/dt$ having a frequency equal to the predetermined high frequency HF (block 270). It should be pointed out that component $A_{HF}$ represents the peak-to-peak amplitude of the oscillations of $A_{HF}$ during resonance.

At this point, processing block 14 determines a dynamic unbalance parameter, i.e. component $T_{dynHF}$, according to the equation:

$$T_{dynHF}=A_{HF}-A_{HFREF}$$

Processing block 14 determines (block 290) whether component $T_{dynHF}$ is below a predetermined maximum unbalance threshold $T_{dynHFMAX}$, which, in the case in point, is associated with an unacceptably hazardous dynamic unbalance condition, and in consequence an unacceptably, motion of the wash assembly 3.

If the maximum unbalance parameter, i.e. component $T_{dynHF}$, is below the predetermined maximum unbalance threshold $T_{dynHFMAX}$ (YES output of block 290), processing block 14 determines an acceptable dynamic unbalance condition and in consequence an acceptably motion of the wash assembly 3, again increases rotation speed ω by predetermined value Δω (block 240), and repeats the controls performed in blocks 250-260-270-280-290.

Conversely, if component $T_{dynHF}$, exceeds the predetermined threshold $T_{dynHFMAX}$, (NO output of block 290), processing block 14 determines an unacceptably hazardous dynamic unbalance condition and in consequence an unacceptably motion of the wash assembly 3, commands regulating block 10 to immediately reduce rotation speed ω to achieve a random redistribution of the laundry inside laundry drum 6, and repeats the control steps of blocks 200-290 described above.

Dynamic unbalance control terminates when rotation speed ω of laundry drum 6 reaches the predetermined maximum rotation speed $\omega_{DYN}$ (NO output of block 250). In which case, the method, having detected no unacceptable dynamic unbalance condition when increasing rotation speed over the resonance rotation speed range $D_{FR}$, authorizes the spin stage, and increases rotation speed ω to spin speed $\omega_{SPIN}$.

The method in the FIG. 4 flow chart and/or the variation in FIG. 6 may obviously be coded by means of a software product loadable into a memory (not shown), preferably in processing block 14, and designed, in use, to implement one or both of the operating methods.

The invention claimed is:

1. A method of sensing the motion of a wash assembly due to a dynamic unbalance of a wash laundry drum assembly in a washing machine comprising a casing and the wash assembly which comprises a tub connected in a floating manner to said casing and the laundry drum assembly; said laundry drum assembly comprising a laundry drum mounted to rotate freely about a longitudinal axis of rotation inside said tub and means for rotating said laundry drum about said axis of rotation;

said method comprising the steps of:

a) increasing the rotation speed (ω) of said laundry drum to a first rotation speed ($\omega_{DIST}$) at which the laundry adheres, in a fixed distribution pattern, to the inner wall of said laundry drum;

b) determining, when said first rotation speed ($\omega_{DIST}$) is reached, a first parameter related to a time pattern of the values of an unbalance function $A=T-Jd\omega/dt$ filtered at a predetermined filtration frequency; T and ω being the torque and rotation speed, respectively, imparted to said laundry drum, and J being the moment of inertia of said laundry drum assembly;

c) as of said first rotation speed ($\omega_{DIST}$), repeatedly increasing the rotation speed ($\omega$) of the laundry drum by a predetermined value ($\Delta\omega$) to cover a predetermined resonance rotation speed range ($D_{FR}$) of the wash assembly;

d) determining, at each increase ($\Delta\omega$) in rotation speed ($\omega$) within said predetermined resonance rotation speed range ($D_{FR}$), a second parameter related to the time pattern of the values of said unbalance function $A=T-Jd\omega/dt$ filtered at said predetermined filtration frequency;

e) calculating a difference between said second parameter and said first parameter;

f) determining a dynamic unbalance parameter related to the dynamic unbalance torque of said laundry drum assembly as a function of said difference.

2. A method as claimed in claim 1, and further comprising the step of:

g) reducing the rotation speed ($\omega$) of said laundry drum to below said first rotation speed ($\omega_{DIST}$) to redistribute the laundry inside said laundry drum, when said dynamic unbalance parameter exceeds a predetermined dynamic unbalance threshold.

3. A method as claimed in claim 2, wherein said resonance rotation speed range ($D_{FR}$) ranges between a minimum rotation speed ($\omega_{Rmin}$) and a maximum rotation speed ($\omega_{RMAX}$);

said method comprising the step of:

commanding an increase in the rotation speed ($\omega$) of said laundry drum to a predetermined spin speed ($\omega_{SPIN}$), in the event the rotation speed ($\omega$) of said laundry drum exceeds said maximum rotation speed ($\omega_{RMAX}$) without said dynamic unbalance parameter exceeding said predetermined dynamic unbalance threshold.

4. A method as claimed in claim 2, wherein said step b) comprises the step of:

b2) filtering said unbalance function $A=T-Jd\omega/dt$ to determine a relative component having a high frequency (HF) which is at least twice the rotation frequency of said laundry drum; and wherein said second parameter corresponds to the amplitude of said component of the unbalance function $A=T-Jd\omega/dt$ having said high frequency (HF).

5. A method as claimed in claim 2, wherein said step b) comprises the step of:

b1) filtering said unbalance function $A=T-Jd\omega/dt$ to determine a relative component having a low frequency (LF) lower than the rotation frequency of said laundry drum; and wherein said first parameter corresponds to the amplitude of said component of the unbalance function $A=T-Jd\omega/dt$ having said low frequency (LF).

6. A method as claimed in claim 2, wherein said step d) comprises the step of:

d2) filtering said unbalance function $A=T-Jd\omega/dt$ to determine a relative component having a high frequency (HF) which is at least twice the rotation frequency of said laundry drum; and wherein said second parameter corresponds to the amplitude of said component of the unbalance function $A=T-Jd\omega/dt$ having said high frequency (HF).

7. A washing machine comprising a casing, a wash assembly which comprises a tub connected in a floating manner to said casing and a laundry drum assembly; said laundry drum assembly comprising a laundry drum mounted to rotate freely about a longitudinal axis of rotation inside said tub and means for rotating said laundry drum about said axis of rotation; said washing machine comprising control means for sensing the motion of said wash assembly due to the dynamic unbalance of said laundry drum assembly, and which is configured to implement a method as claimed in claim 2.

8. An electronic control device for sensing motion of a wash assembly due to a dynamic unbalance of a laundry drum assembly of a washing machine, said control device being configured to implement, in said washing machine, a method as claimed in claim 2.

9. A computer readable medium containing instructions loadable into a memory of control means, and designed to implement, in use, a method as claimed in claim 2.

10. A method as claimed in claim 1, wherein said resonance rotation speed range ($D_{FR}$) ranges between a minimum rotation speed ($\omega_{Rmin}$) and a maximum rotation speed ($\omega_{RMAX}$);

said method comprising the step of:

commanding an increase in the rotation speed ($\omega$) of said laundry drum to a predetermined spin speed ($\omega_{SPIN}$), in the event the rotation speed ($\omega$) of said laundry drum exceeds said maximum rotation speed ($\omega_{RMAX}$) without said dynamic unbalance parameter exceeding said predetermined dynamic unbalance threshold.

11. A method as claimed in claim 10, wherein said step b) comprises the step of:

b1) filtering said unbalance function $A=T-Jd\omega/dt$ to determine a relative component having a low frequency (LF) lower than the rotation frequency of said laundry drum; and wherein said first parameter corresponds to the amplitude of said component of the unbalance function $A=T-Jd\omega/dt$ having said low frequency (LF).

12. A method as claimed in claim 10, wherein said step d) comprises the step of:

d2) filtering said unbalance function $A=T-Jd\omega/dt$ to determine a relative component having a high frequency (HF) which is at least twice the rotation frequency of said laundry drum; and wherein said second parameter corresponds to the amplitude of said component of the unbalance function $A=T-Jd\omega/dt$ having said high frequency (HF).

13. A washing machine comprising a casing, a wash assembly which comprises a tub connected in a floating manner to said casing and a laundry drum assembly; said laundry drum assembly comprising a laundry drum mounted to rotate freely about a longitudinal axis of rotation inside said tub and means for rotating said laundry drum about said axis of rotation; said washing machine comprising control means for sensing the motion of said wash assembly due to the dynamic unbalance of said laundry drum assembly, and which is configured to implement a method as claimed in claim 10.

14. An electronic control device for sensing motion of a wash assembly due to a dynamic unbalance of a laundry drum assembly of a washing machine, said control device being configured to implement, in said washing machine, a method as claimed in claim 10.

15. A computer readable medium containing instructions loadable into a memory of control means, and designed to implement, in use, a method as claimed in claim 10.

16. A method as claimed in claim 1, wherein said step b) comprises the step of:

b1) filtering said unbalance function $A=T-Jd\omega/dt$ to determine a relative component having a low frequency (LF) lower than the rotation frequency of said laundry drum; and wherein said first parameter corresponds to the amplitude of said component of the unbalance function $A=T-Jd\omega/dt$ having said low frequency (LF).

17. A method as claimed in claim 16, wherein said step d) comprises the step of:

d1) filtering said unbalance function $A=T-Jd\omega/dt$ to determine a relative component having said low frequency (LF); and wherein said second parameter corresponds to the amplitude of said component of the unbalance function $A=T-Jd\omega/dt$ having said low frequency (LF).

18. A method as claimed in claim 1, wherein said step b) comprises the step of:

b2) filtering said unbalance function $A=T-Jd\omega/dt$ to determine a relative component having a high frequency (HF) which is at least twice the rotation frequency of said laundry drum; and wherein said second parameter corresponds to the amplitude of said component of the unbalance function $A=T-Jd\omega/dt$ having said high frequency (HF).

19. A method as claimed in claim 18, wherein said step d) comprises the step of:

d2) filtering said unbalance function $A=T-Jd\omega/dt$ to determine a relative component having a high frequency (HF) which is at least twice the rotation frequency of said laundry drum; and wherein said second parameter corresponds to the amplitude of said component of the unbalance function $A=T-Jd\omega/dt$ having said high frequency (HF).

20. A washing machine comprising a casing, a wash assembly which comprises a tub connected in a floating manner to said casing and a laundry drum assembly; said laundry drum assembly comprising a laundry drum mounted to rotate freely about a longitudinal axis of rotation inside said tub and means for rotating said laundry drum about said axis of rotation; said washing machine comprising control means for sensing the motion of said wash assembly due to the dynamic unbalance of said laundry drum assembly, and which is configured to implement a method as claimed in claim 1.

21. An electronic control device for sensing motion of a wash assembly due to a dynamic unbalance of a laundry drum assembly of a washing machine, said control device being configured to implement, in said washing machine, a method as claimed in claim 1.

22. A computer readable medium containing instructions loadable into a memory of control means, and designed to implement, in use, a method as claimed in claim 1.

* * * * *